US006315610B1

(12) United States Patent
Zheng et al.

(10) Patent No.: US 6,315,610 B1
(45) Date of Patent: Nov. 13, 2001

(54) ELECTRICAL CONNECTOR FOR MOUNTING ON A BOTTOM SIDE OF A PRINTED CIRCUIT BOARD

(75) Inventors: Qi Sheng Zheng; Hong bin Zhou; Ming Ge, all of Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/746,093

(22) Filed: Dec. 21, 2000

(30) Foreign Application Priority Data

Oct. 20, 2000 (TW) ..... 89218232 U

(51) Int. Cl.[7] ..... H01R 13/648
(52) U.S. Cl. ..... 439/607
(58) Field of Search ..... 439/607, 609, 439/610, 680, 681

(56) References Cited

U.S. PATENT DOCUMENTS 4,878,858 * 11/1989 Dechelette ..... 439/607
5,035,652 * 7/1991 Shibano ..... 439/607
5,637,015 * 6/1997 Tan et al. ..... 439/607
5,738,544 * 4/1998 Davis ..... 439/607

* cited by examiner

*Primary Examiner*—Brian Sircus
*Assistant Examiner*—Phuong K T Dinh
(74) *Attorney, Agent, or Firm*—Wei Te Chung

(57) ABSTRACT

An electrical connector (100) mountable on a bottom side of a PCB (200) includes a dielectric housing (40), a plurality of terminals (50) retained in the housing, and a shielding case (130) covering the housing. The shielding case has a front section (20) with an upwardly protruding orientation key (210), a rear section (30) and a covering section (10). The covering section is formed from one piece of metal sheet and provides a pair of side walls (12), a transverse wall (11) interconnected therebetween, two metal feet (120) projecting upwardly from corresponding side walls for securing the connector to the PCB and a detent lock (110) formed in a middle of the transverse wall bending inwardly and rearwardly for providing a retention force against a mating complementary connector.

9 Claims, 6 Drawing Sheets

ELECTRICAL CONNECTOR FOR MOUNTING ON A BOTTOM SIDE OF A PRINTED CIRCUIT BOARD

BACKGROUND OF THE INVENTION

1. Field of the Invention

The present invention generally relates to an electrical connector, and particularly to an electrical connector mounted on a bottom side of a printed circuit board.

2. Description of the Prior Art

Electrical connectors mounted on a printed circuit board (PCB) are well known in the art. IEEE 1394 electrical connectors include a shielding case having a mating orientation key formed on a mating sleeve of the shielding case for securing correct polarity of a mating complementary connector. The key is formed on a lower side of the mating sleeve and has an inwardly indented surface. A detent lock is formed on the shielding case protruding into a housing of the connector in opposition to the key on the mating sleeve. The key and the detent lock cooperate to secure the complementary connector in the electrical connector. The shielding case also forms a pair of metal feet on a side opposite to that forming the detent lock and adjacent to the key for mounting the electrical connector to the PCB. Under special circumstances, the electrical connectors may be required to be mounted on a bottom side of the PCB. Referring to FIG. 6, a conventional IEEE 1394 electrical connector 500 is mounted on a top side of a PCB 200. Note that a mating orientation key 510 is positioned on a lowermost panel of a mating sleeve (not labeled). An identical electrical connector 600 is shown mounted on a bottom side of the PCB 200 with a key 610 now being positioned on an uppermost panel of a mating sleeve (not labeled). A complementary connector (not shown) which is mated right-side-up with the electrical connector 500 must be turned upside-down to properly mate with the electrical connector 600. An incorrect mating between the electrical connector 600 and the complementary connector may damage either or both of the connectors.

Heretofore, to avoid the aforementioned mismating action, the key 610 of the electrical connector 600 mounted on the bottom side of the PCB 200 was provided on a bottom panel of the mating sleeve so that a mating orientation of the complementary connector remained unchanged. A detent lock 611 of the connector 600 was correspondingly moved to an upper side of the shielding case but was now separated from the shielding case because of the limitation imposed by the location of the metal feet 612. However, with the ever-increasing transmission speeds of applications, along with the consequent higher quality required from electrical connectors, such a configuration is often impractical and is neither cost nor quality effective.

Hence, an improved electrical connector is required to overcome the aforementioned problems.

BRIEF SUMMARY OF THE INVENTION

A first object of the present invention is to provide an improved electrical connector mountable to a bottom side of a printed circuit board with the direction of insertion of a complementary connector unchanged.

A second object of the present invention is to provide an improved electrical connector mountable to a bottom side of a printed circuit board with a detent lock and a pair of metal feet all made from a single piece of metal sheet.

To achieve the aforementioned objects, an electrical connector mountable on the bottom side of a printed circuit board comprises a dielectric housing, a plurality of terminals received in the housing and a shielding case enclosing the dielectric housing. The shielding case includes a front section, a rear section and a covering section. The front section includes a mating sleeve with an inwardly protruding key on a bottom panel thereof. The covering section is formed from one piece of metal sheet and comprises a pair of side walls, a transverse top wall interconnecting the side walls, two metal feet projecting upwardly from an upper edge of each side wall for securing the connector to a PCB, and a detent lock formed in a middle of the transverse top wall and bending inwardly and rearwardly. The detent lock is received in a corresponding slot of the dielectric housing for providing a mating retention.

DETAILED DESCRIPTION OF THE INVENTION

Figure 1:
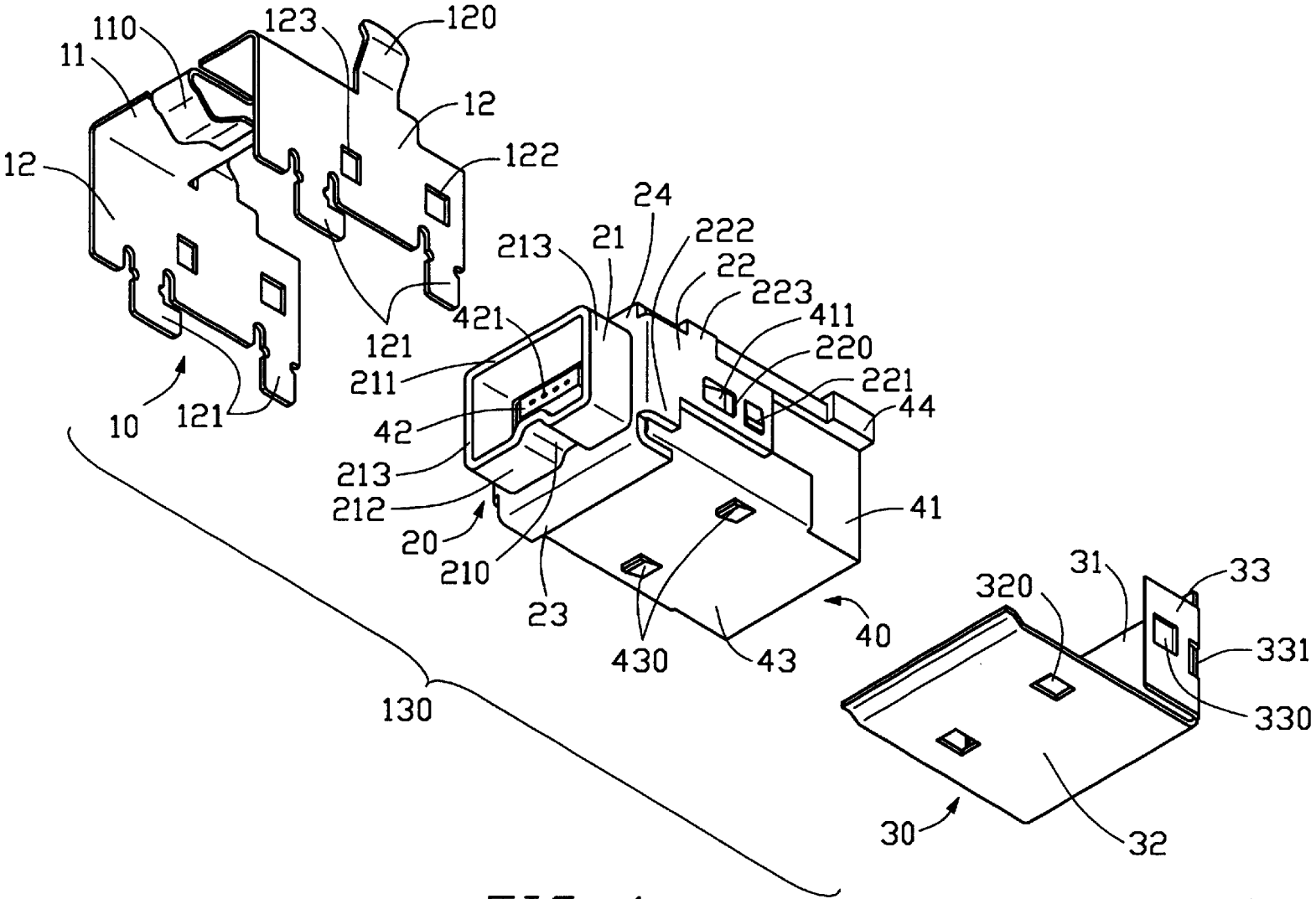
FIG. 1 is an exploded view of an electrical connector in accordance with the present invention.
Figure 2:
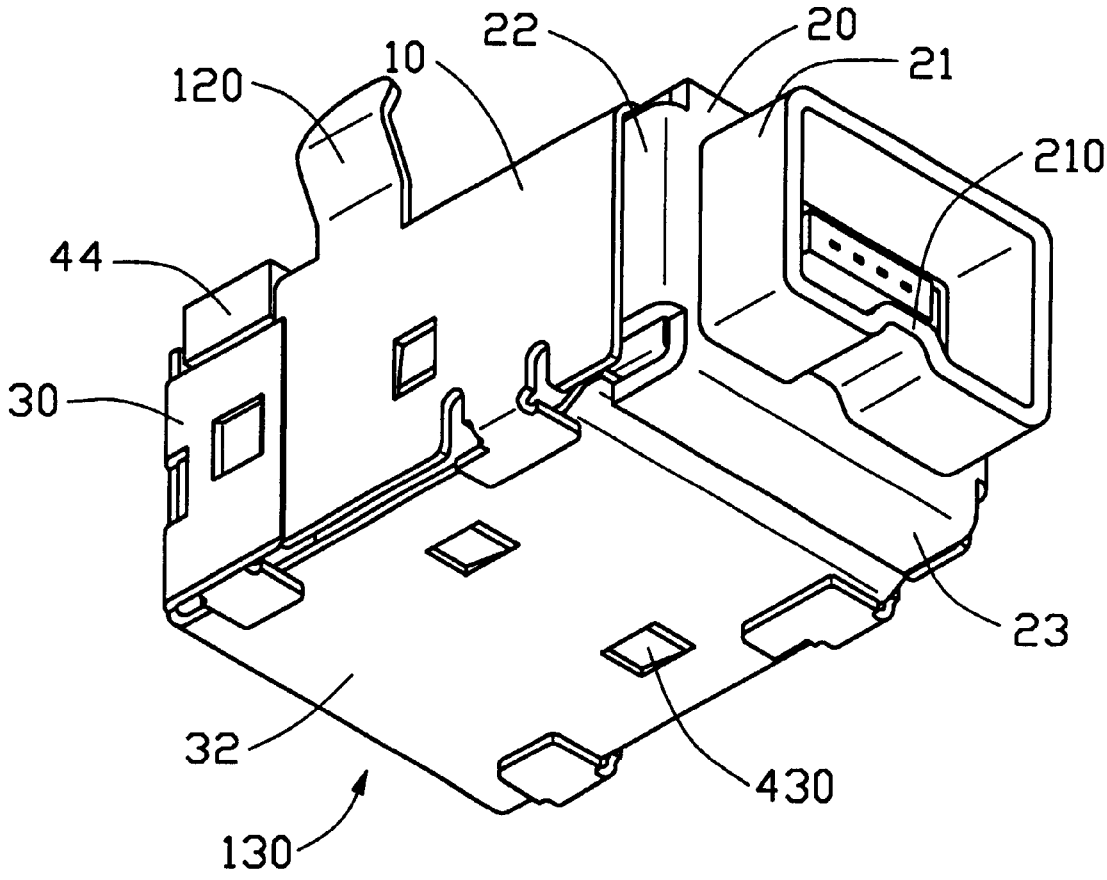
FIG. 2 is an assembled view of FIG. 1.
Figure 3:
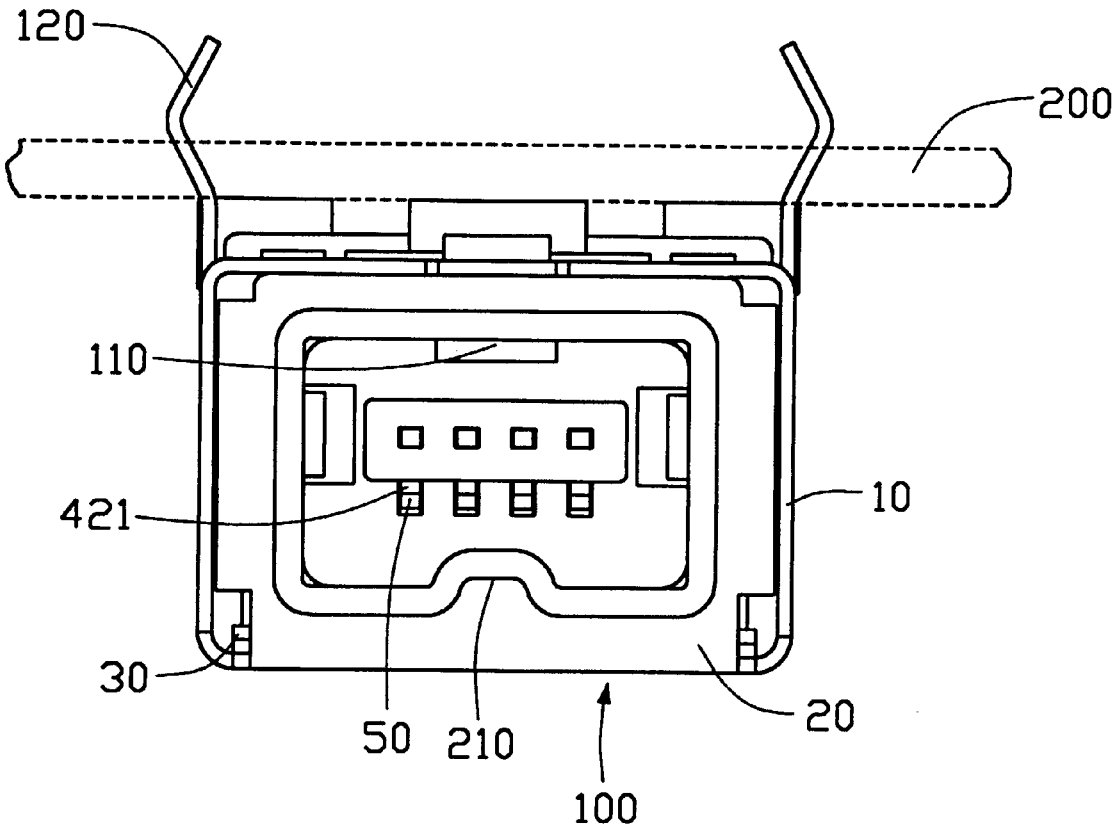
FIG. 3 is a frontal view of the electrical connector of FIG. 2 mounted on a printed circuit board.
Figure 4:
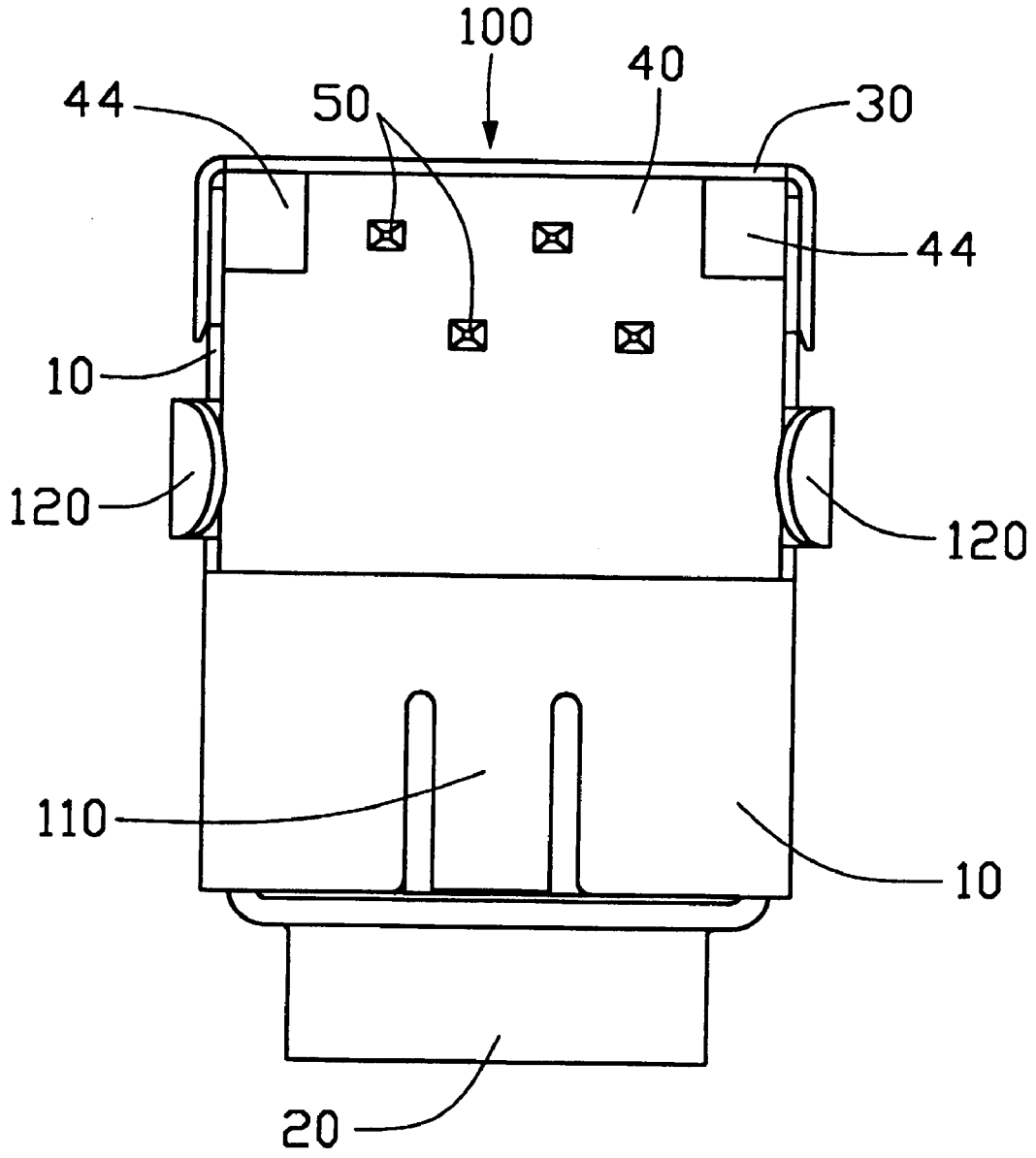
FIG. 4 is a top plan view of the electrical connector of FIG. 2.

Referring to FIGS. 1–3, the present invention is an embodiment of an IEEE 1394 electrical connector 100 mountable on a bottom side of a printed circuit board 200 (IEEE stands for the Institute of Electrical & Electronic Engineers). The electrical connector 100 comprises a dielectric housing 40, a plurality of terminals 50 and a conductive metal shielding case 130. The shielding case 130 includes a conductive front section 20 covering a front of the dielectric housing 40, a conductive covering section 10 for shielding a top and sides of the housing 40, and a conductive rear section 30 enclosing a bottom and a rear of the dielectric housing 40.

The dielectric housing 40 is generally in the shape of a rectangular box and includes a base 41 and a mating tongue 42 projecting from a front end of the base 41. The base 41 and the mating tongue 42 define a plurality of passageways 421 therethrough for receiving the terminals 50. The base 41 forms two blocks 430 on a bottom face 43 and a pair of protrusions 44 at opposite sides thereof at a rear end of the base 41. The configuration of other portions of the dielectric housing 40 and the terminals 50 is the same as that of a conventional IEEE 1394 electrical connector.

Referring to FIG. 1, the front section 20 of the shielding case 130 comprises a mating sleeve 21 projecting forwardly from a front plate 24 to define a mating opening therein, and a pair of side plates 22 respectively extending backward from opposite sides of the front plate 24. The mating sleeve 21 is four sided and comprises a top panel 211, an opposite bottom panel 212 and two side panels 213. An inwardly protruding key 210 is formed on the bottom panel 212 of the mating sleeve 21 for axially guiding an accurate insertion of a complementary connector (not shown) and for assuring proper polarity with the complementary connector. Each side plate 22 defines a stair-shaped tab 222 adjacent to the front plate 24, a rectangle-shaped tab 223 opposite to the stair-shaped tab 222, a third aperture 220 and a first tab 221 beside the third aperture 220. Additionally, the front section 20 also has a bottom plate 23 extending rearwardly from a lower edge of the front plate 24.

The rear section 30 of the shielding case 130 includes a rear wall 31, a bottom wall 32 perpendicular to the rear wall 31 and two side plates 33 which extend forwardly from the rear wall 31. The bottom wall 32 has a pair of fourth apertures 320 corresponding to the blocks 430 for engaging with the blocks 430 of the dielectric housing 40. The two side walls 33 each respectively define a second tab 330 thereon and a notch 331 adjacent to the rear wall 31.

Figure 5:
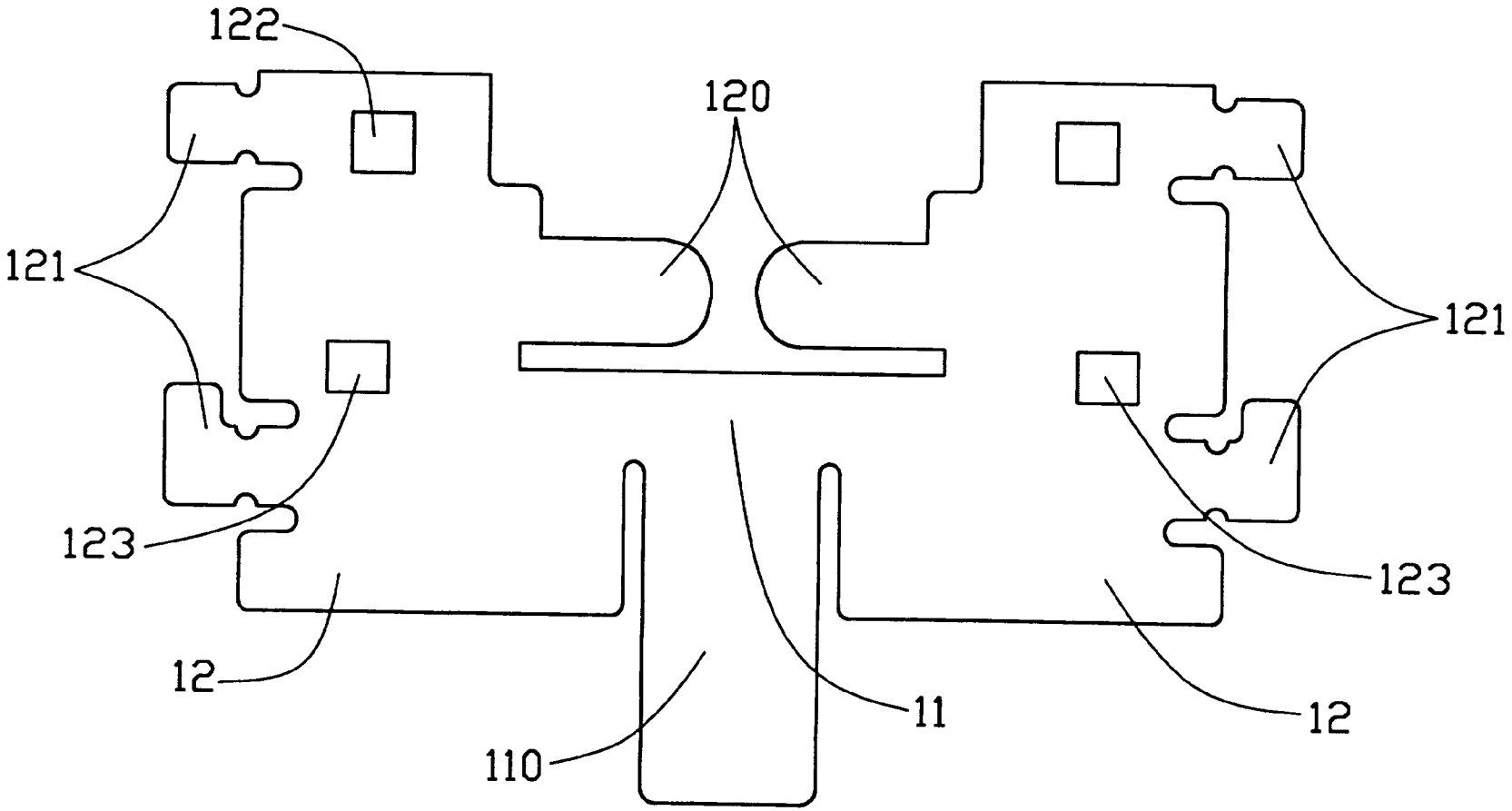
FIG. 5 is a plan view of a covering section of the shielding case of FIG. 1, prior to bending.
Figure 6:
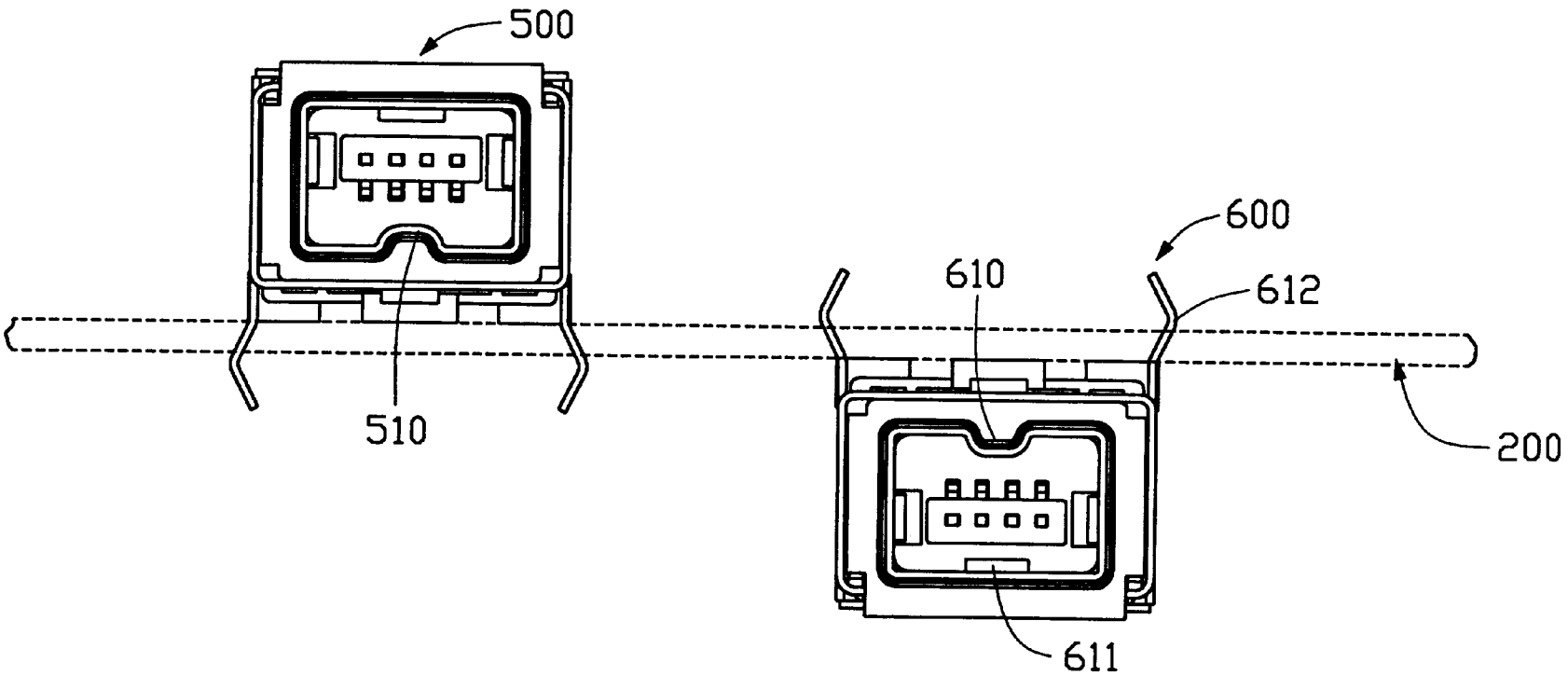
FIG. 6 (PRIOR ART)
FIG. 6 is a frontal view of two conventional electrical connectors mounted respectively on a top and a bottom side of a printed circuit board.

Referring to FIGS. 5 and 6, the covering section 10 of the present invention is made from one piece of metal sheet and comprises a transverse top wall 11 and a pair of side walls 12 depending from opposite side edges of the transverse top wall 11. A detent lock 110 is formed in a middle of the transverse top wall 11 and is bent inwards and rearwards to protrude through a corresponding slot (not shown) of the housing 40 to engage with a shield of the complementary connector for mating retention and grounding purposes. Two metal feet 120 extend upwardly from opposite side walls 12 for insertion into holes (not shown) in the printed circuit board 200, for making a soldered connection between the IEEE 1394 electrical connector 100 and the printed circuit board 200. A pair of fixing tabs 121 depends from a lower edge of each side wall 12, which can be bent inwardly for securing against the bottom face 43 of the dielectric housing 40. The side walls 12 also define a pair of first apertures 123 and a pair of second apertures 122.

Referring to FIG. 2, in assembly, the front section 20 is fixed to the front end of the base 41, with the mating sleeve 21 fitting around the mating tongue 42 and the third apertures 220 engaging with the side blocks 411. Then the rear section 30 covers a rear end of the base 41 with the fourth apertures 320 of the rear section 30 engaging with the blocks 430 on the bottom face 43 of the dielectric housing 40. Finally, the covering section 10 covers the top of the dielectric housing 40 with the detent lock 110 extending through the slot (not shown) in the top face (not labeled) of the housing 40 and the fixing tabs 121 being bent inwardly to overlap the bottom wall 32 of the rear section 30. The first tabs 221 of the front section 20 and the second tabs 330 of the rear section 30 engage respectively with the first apertures 123 and the second apertures 122 of the covering section 10. Thus the shielding case 130 is securely attached to the housing 40 and the IEEE 1394 electrical connector of the present invention can be securely mounted to the bottom side of the printed circuit board 200. Since the inwardly protruding key 210 is formed on a lower side of the mating sleeve 21, the present invention has the advantage of being able to couple with the complementary connector without inverting the complementary connector. The detent lock 110 is positioned opposite the key 210 and is integral with the covering section 10 of the shielding case 130. Thus, the chance of damaging the IEEE 1394 electrical connector or the complementary connector through mismating is diminished and the connector provides a higher quality, lower cost shielding case than the prior art.

It is to be understood, however, that even though numerous characteristics and advantages of the present invention have been set forth in the foregoing description, together with details of the structure and function of the invention, the disclosure is illustrative only, and changes may be made in detail, especially in matter of shape, size, and arrangement of parts within the principles of the invention to the full extent indicated by the broad general meaning of the terms in which the appended claims are expressed.

What is claimed is:

1. An electrical connector mountable on a bottom side of a printed circuit board comprising:

a dielectric housing having a plurality of passageways therein;

a plurality of terminals received in corresponding passageways; and a shielding case enclosing the dielectric housing and having a mating sleeve, the mating sleeve having an inwardly protruding orientation key on a lower portion thereof away from the printed circuit board and covering a front of the dielectric housing and defining a mating opening, a pair of metal feet upwardly protruding from an uppermost side of the shielding case for engaging with the printed circuit board, and a detent lock for providing a retention force against a mated complementary connector, wherein the detent lock and the metal feet are formed from same piece of metal sheet and are located at the same side of the housing.

2. The electrical connector as claimed in claim 1, wherein the shielding case includes a front section including the mating sleeve and covering the front of the dielectric housing, a covering section covering a top of the housing and a rear section covering a bottom and rear of the dielectric housing.

3. The electrical connector as claimed in claim 2, wherein the orientation key of the mating sleeve is defined in a middle of the lower portion of the mating sleeve and protrudes in an upward direction.

4. The electrical connector as claimed in claim 2, wherein the covering section is made from one piece of metal sheet and includes a pair of side walls and a transverse top wall connected therebetween.

5. The electrical connector as claimed in claim 4, wherein the metal feet extend upward from the edges of the side walls closest to the printed circuit board.

6. The electrical connector as claimed in claim 4, wherein the detent lock is formed on the covering section and bends inwardly, and extends rearwardly in a direction parallel to the printed circuit board.

7. The electrical connector as claimed in claim 5, wherein a plurality of fixing tabs extend from the ends of the side walls of the covering section furthest from the printed circuit board and opposite to the metal feet.

8. The electrical connector as claimed in claim 1, wherein the front section of the shielding case encloses the front and sides of the housing.

9. An electrical connector assembly comprising:

a printed circuit board and a connector mounted to an underside of said printed circuit board;

said connector including:

a dielectric housing having a plurality of terminals therein;

a orientation key formed on a lower portion of an mating opening of the connector away from said printed circuit board;

a shielding case mounted on the housing, said shielding case including a U-shaped cover section from which a pair of metal feet upwardly extends to engage the printed circuit board, and a detent lock extends inwardly about an upper portion of said mating opening opposite to said key and between said printed circuit board and said key.

* * * * *